US010183831B1

(12) United States Patent
Yamamoto

(10) Patent No.: US 10,183,831 B1
(45) Date of Patent: Jan. 22, 2019

(54) POST-PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Mikio Yamamoto, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/680,374

(22) Filed: Aug. 18, 2017

(51) Int. Cl.

| | |
|---|---|
| ***B65H 37/04*** | (2006.01) |
| ***B65H 43/00*** | (2006.01) |
| ***B65H 31/26*** | (2006.01) |
| *B65H 37/06* | (2006.01) |

(52) U.S. Cl.
CPC ..... *B65H 37/04* (2013.01); *B65H 31/26* (2013.01); *B65H 43/00* (2013.01); *B65H 37/06* (2013.01); *B65H 2301/4223* (2013.01); *B65H 2301/5123* (2013.01); *B65H 2801/27* (2013.01)

(58) Field of Classification Search
CPC ..... B65H 37/04; B65H 37/06; B65H 43/00; B65H 2801/27; B65H 31/26; B65H 2301/4223; B65H 2301/5123
USPC ..... 270/37, 45, 58.07, 58.08, 58.09, 52.18
See application file for complete search history.

(56) References Cited

U.S. PATENT DOCUMENTS

| | | | | |
|---|---|---|---|---|
| 5,382,011 | A * | 1/1995 | Tani | G03G 15/6541 270/37 |
| 6,145,825 | A * | 11/2000 | Kunihiro | B42C 1/12 227/29 |
| 6,171,225 | B1 | 1/2001 | Nonoyama | |
| 7,434,796 | B2 * | 10/2008 | Kushida | B42B 4/00 270/58.08 |
| 7,455,291 | B2 * | 11/2008 | Reeves | B65H 9/06 271/181 |
| 7,575,229 | B2 * | 8/2009 | Kushida | B42B 4/00 270/58.08 |
| 7,866,650 | B2 * | 1/2011 | Nomura | B42C 1/12 270/58.07 |

FOREIGN PATENT DOCUMENTS

| | | |
|---|---|---|
| JP | 2004-83261 | 3/2004 |

* cited by examiner

*Primary Examiner* — Leslie A Nicholson, III
(74) *Attorney, Agent, or Firm* — Amin, Turocy & Watson LLP

(57) ABSTRACT

In accordance with an embodiment, a post-processing apparatus comprises a knocking section, a receiving section, a driving section and a pressing section. The knocking section knocks a staple in a sheet. The receiving section faces the knocking section. The receiving section receives the sheet in which the staple is knocked from the knocking section. The driving section can change an interval between the knocking section and the receiving section in an opposite direction in which the knocking section and the receiving section face each other. The pressing section extends continuously in a sheet width direction. The pressing section presses the sheet before the staple is knocked in the sheet.

18 Claims, 10 Drawing Sheets

POST-PROCESSING APPARATUS

FIELD

Embodiments described herein relate generally to post-processing apparatuses and methods relates thereto.

BACKGROUND

There is known a post-processing apparatus for executing a post-processing on a sheet conveyed from an image forming apparatus (e.g., an MFP). The post-processing apparatus includes a processing section executing a stapling processing or a sorting processing on the conveyed sheet. In addition, the post-processing apparatus includes a saddle folding unit for executing saddle folding, i.e., folding a bundle of a plurality of sheets in half. A sheet is conveyed from the image forming apparatus via a sheet path to the saddle folding unit. The sheet conveyed to the saddle folding unit is accepted by a stacker. For example, the stacker accepts the conveyed sheet through a standing posture. A stapling unit for executing the stapling processing on the sheet is arranged above the stacker.

However, if the stapling unit knocks a staple in the sheet, there is possibility of causing deflection in the sheet in a sheet width direction. If the deflection in the sheet is caused, there is a likely possibility that a position of the staple in the sheet is deviated from the intended position to an unintended position.

DETAILED DESCRIPTION

Figure 1:
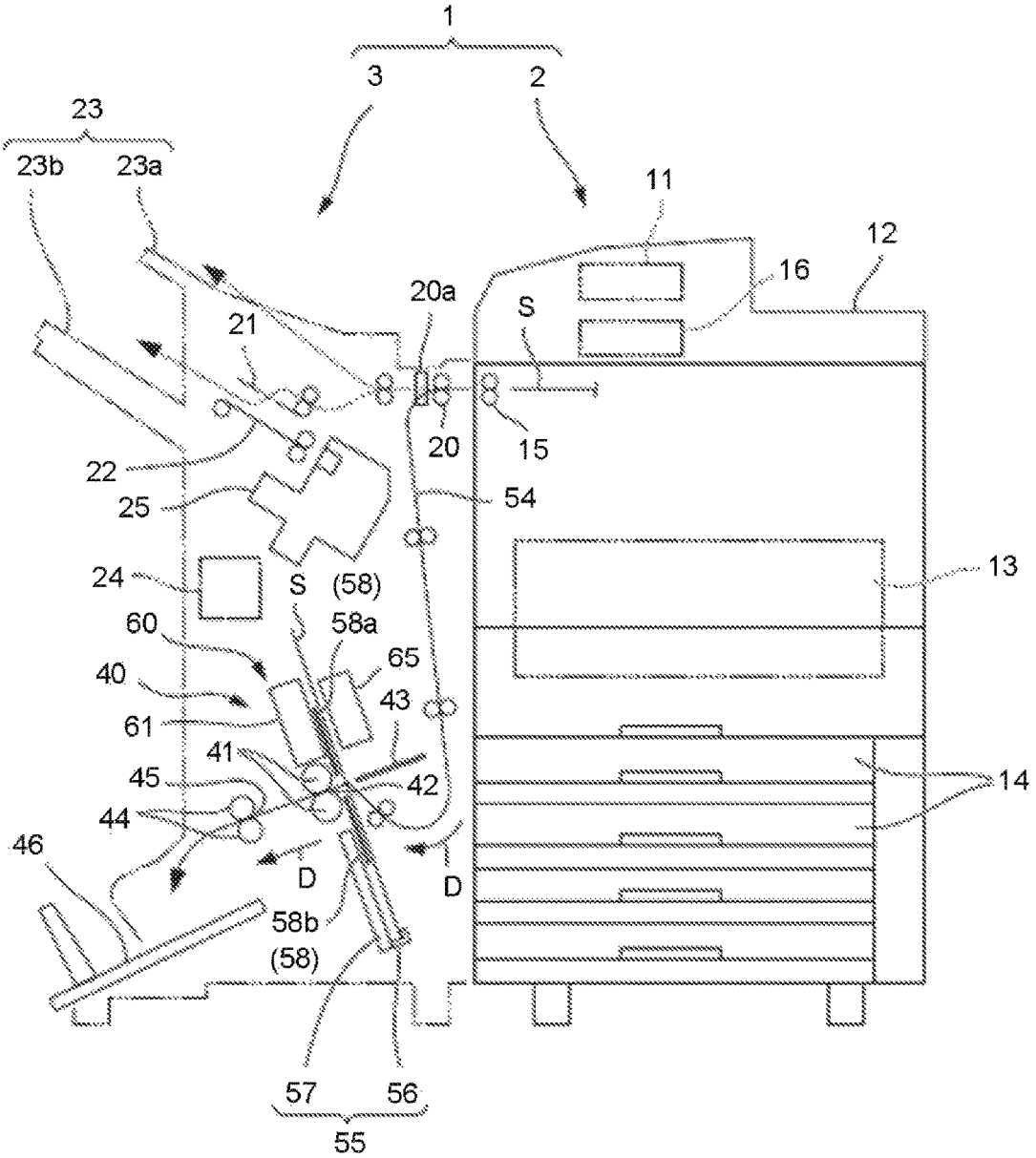
FIG. 1 is a diagram illustrating an example of an image forming system according to an embodiment.

In accordance with an embodiment, a post-processing apparatus comprises a knocking section, a receiving section, a driving section and a pressing section. The knocking section knocks a staple in a sheet. The receiving section faces the knocking section. The receiving section receives the sheet in which the staple is knocked from the knocking section. The driving section can change an interval between the knocking section and the receiving section in an opposite direction in which the knocking section and the receiving section face each other. The pressing section extends continuously in a sheet width direction. The pressing section presses the sheet before the staple is knocked in the sheet.

In accordance with another embodiment, a method of reducing deviation from an intended position of a staple in a sheet to an unintended position of the staple in the sheet involves receiving the sheet in which a staple is knocked in a receiving section; pressing the sheet continuously in a sheet width direction before the staple is knocked in the sheet a pressing section; knocking a staple in the sheet using a knocking section facing the receiving section; and changing an interval between the knocking section and the receiving section in an opposite direction in which the knocking section and the receiving section face each other.

Hereafter, a post-processing apparatus of an embodiment is described with reference to the accompanying drawings. In the following description, the same component is donated with the same reference numeral.

FIG. 1 is a diagram illustrating an example of an image forming system 1 according to an embodiment.

As shown in FIG. 1, the image forming system. 1 is provided with an image forming apparatus 2 and a post-processing apparatus 3. The image forming apparatus 2 forms an image on a sheet-like image receiving medium (hereinafter, referred to as a "sheet S") such as a paper. For example, the image forming apparatus 2 is an MFP (Multi-Function Peripherals), a printer, a copier, etc. The post-processing apparatus 3 executes a post-processing on the sheet S conveyed from the image forming apparatus 2. The sheet S includes plastic sheet such as an OHP (Overhead projector) sheet and is not limited to the paper. The sheet S is not limited to being sent from the image forming apparatus 2 to the post-processing apparatus 3, but it can also be sent by hand to the post-processing apparatus 3.

Figure 2:
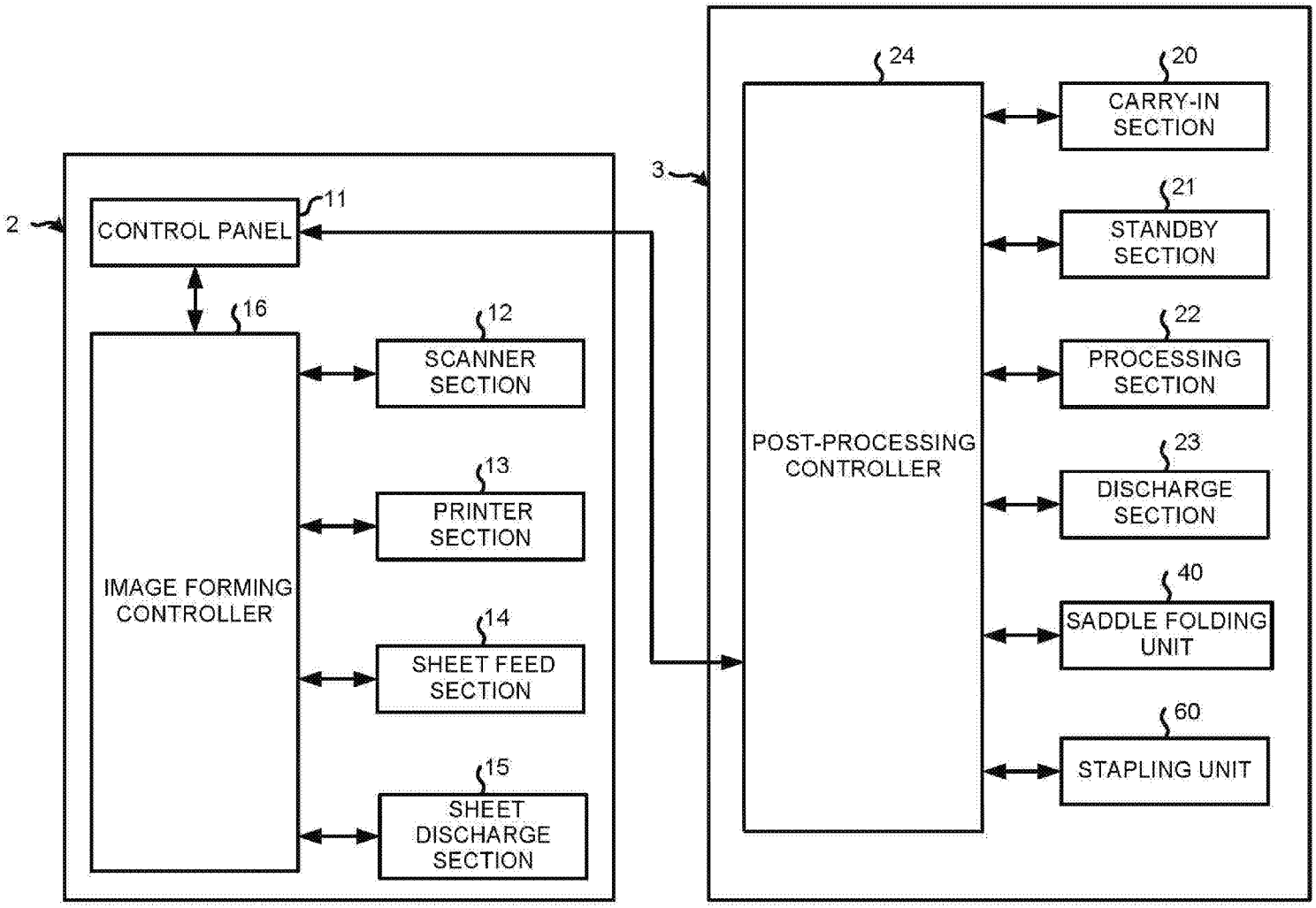
FIG. 2 is a block diagram illustrating the constitution of the image forming system according to the embodiment.

FIG. 2 is a block diagram illustrating the constitution of the image forming system 1 according to the embodiment.

As shown in FIG. 2, the image forming apparatus 2 includes a control panel 11, a scanner section 12, a printer section 13, a sheet feed section 14, a sheet discharge section 15 and an image forming controller 16.

The control panel 11 is provided with various keys or a touch panel for receiving operations by a user. The control panel 11 receives an input relating to a type of a post-processing on the sheet S. The image forming apparatus sends information relating to the type of the post-processing input by the control panel 11 to the post-processing apparatus 3.

The scanner section 12 includes a reading section for reading an image to be copied. The scanner section 12 sends read image information to the printer section 13.

The printer section 13 forms an output image (hereinafter, referred to as a "toner image") by a developer such as a toner according to the image information sent from the scanner section 12 or an external device. The printer section 13 transfers the toner image onto the surface of the sheet S. The printer section 13 applies heat and pressure to the toner image transferred onto the sheet S to fix the toner image on the sheet S.

The sheet feed section 14 supplies sheets S one by one to the printer section 13 in accordance with a timing at which the printer section 13 forms the toner image.

The sheet discharge section 15 conveys the sheet S discharged from the printer section 13 to the post-processing apparatus 3.

The image forming controller 16 controls the whole operation of the image forming apparatus 2. The image forming controller 16 controls the control panel 11, the scanner section 12, the printer section 13, the sheet feed section 14 and the sheet discharge section 15. The image forming controller 16 is formed by a control circuit including a CPU (Central Processing Unit), a ROM (Read Only Memory), and a RAM (Random Access Memory).

Next, the post-processing apparatus 3 is described.

As shown in FIG. 1, the post-processing apparatus 3 is arranged adjacently to the image forming apparatus 2. The sheet S is conveyed from the image forming apparatus 2 to the post-processing apparatus 3. The post-processing apparatus 3 executes the post-processing designated through the control panel 11 to the conveyed sheet S. For example, the post-processing apparatus 3 executes a sorting processing and a stapling processing. For example, the post-processing apparatus 3 executes a sheet folding processing for folding the sheet S in half to discharge the sheet.

The post-processing apparatus 3 includes a carry-in section 20, a standby section 21, a processing section 22, a discharge section 23, a post-processing controller 24 (controller), a saddle folding unit 40 and a stapling unit 60.

The carry-in section 20 is connected to a downstream side in a conveyance direction of the sheet discharge section 15. The carry-in section 20 receives the sheet S conveyed from the image forming apparatus 2. The sheet discharge section 15 is connected to a sheet feed apparatus (not shown).

The standby section 21 temporarily retains (buffers) the sheet S conveyed from the image forming apparatus 2. The standby section 21 is arranged above the processing section 22. If the processing section 22 is idle, the standby section 21 drops the buffered sheet S towards the processing section 22.

The processing section 22 carries out the post-processing on the conveyed sheet S. For example, the processing section 22 executes the sorting processing for gathering a plurality of sheets S to align them. For example, the processing section 22 carries out a sheet binding processing of binding a sheet bundle obtained by gathering a plurality of sheets S with a staple or an adhesive tape. A reference numeral 25 indicates a sheet binding apparatus for executing a binding processing on the sheet bundle with the staple in the processing section 22. The processing section 22 discharges the sheet S on which the post-processing is carried out to the discharge section 23.

The discharge section 23 includes a fixed tray 23*a* and a movable tray 23*b*. The fixed tray 23*a* is arranged at an upper side of the post-processing apparatus 3. The movable tray 23*b* is arranged on a side of the post-processing apparatus 3. The sheet S from the carry-in section 20 is discharged to the fixed tray 23*a*. The sheet S from the standby section 21 or the processing section 22 is discharged to the movable tray 23*b*.

As shown in FIG. 2, the post-processing controller 24 controls the whole operation of the post-processing apparatus 3. The post-processing controller 24 controls the operation of the carry-in section 20, the standby section 21, the processing section 22, the discharge section 23, the saddle folding unit 40 and the stapling unit 60. Like the image forming controller 16, the post-processing controller 24 is formed by a control circuit including a CPU, a ROM and a RAM.

The saddle folding unit 40 of the post-processing apparatus 3 is described.

As shown in FIG. 1, the post-processing apparatus 3 comprises the saddle folding unit 40 for folding (or saddle folding) one or a plurality of sheets S in half.

The post-processing apparatus 3 conveys the sheet S along the path along the paper surface of FIG. 1. The sheet S is provided with front and back surfaces parallel to a direction orthogonal to the paper surface of FIG. 1. Hereinafter, the direction along the conveyance path of the sheet S in the saddle folding unit 40 is referred to as a sheet conveyance direction D (or simply, conveyance direction). Hereinafter, the direction orthogonal to the paper surface of FIG. 1 is referred to as a sheet width direction W (refer to FIG. 3). The sheet S is a rectangle with two sides along the sheet conveyance direction D and two sides along the sheet width direction W.

The sheet S is conveyed to the saddle folding unit 40 from the image forming apparatus 2 via a sheet path 54. The sheet S conveyed to the saddle folding unit 40 is accepted by a stacker 55.

For example, the stacker 55 accepts the sent sheet S in a standing posture. The stacker 55 tilts the sheet S in such a manner that an upper side of the received sheet S is positioned at the conveyance direction downstream side (a folding roller 41 side). In the case of folding the sheet S in half, the plurality of sheets S is sequentially stacked and received by the stacker 55 to become a bundle.

The sheet S (or the sheet bundle) received by the stacker 55 is supported by a guide member 58 from the conveyance direction downstream side and arranged in a flat shape. At this time, a central part SC (center in the sheet conveyance direction) of the sheet S in a standing direction is opposed to a nip part 42 of the folding roller 41 in a thickness direction of the sheet S (refer to FIG. 3). A folding blade 43 (hereinafter, simply referred to as "blade 43") is arranged in a portion facing the nip part 42 across the sheet S in the thickness direction of the sheet S.

Figure 3:
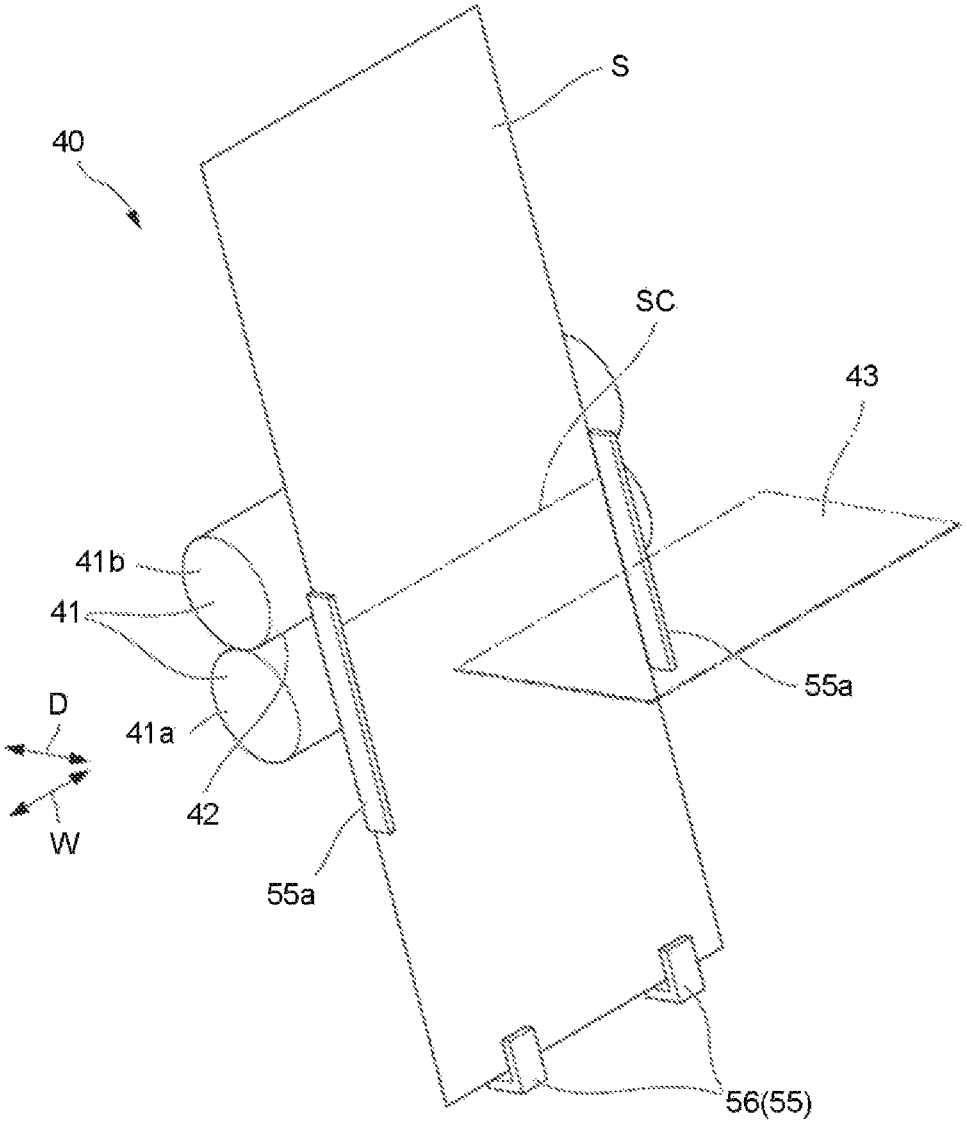
FIG. 3 is a perspective view illustrating an example of a saddle folding unit in a post-processing apparatus according to the embodiment.

As shown in FIG. 3, the blade 43 presses the central part SC of the sheet S in the standing direction towards the nip part 42 of the folding roller 41, and presses the central part SC of the sheet S in the nip part 42. The folding roller 41 rotates while sandwiching the central part SC of the sheet S, and folds the sheet S in half. As shown in FIG. 1, the sheet S folded in half (hereinafter referred to as a "folding body") is conveyed by a discharge roller 44 positioned at the conveyance direction downstream side of the nip part 42 to be discharged to a sheet discharge tray 46. The folding roller and the discharge roller 44 are driven to rotate independently of each other or synchronously by a driving motor (not shown).

In order to switch the conveyance of the sheet S conveyed from the image forming apparatus 2 to the processing section 22 side or to the saddle folding unit 40 side as shown in FIG. 1, a gate 20*a* is provided in the carry-in section 20 of the post-processing apparatus 3. If the sheet folding processing is not executed, the gate 20*a* conveys the sheet S conveyed from the image forming apparatus 2 to the processing section 22 side. If the sheet folding processing is executed, the gate 20*a* conveys the sheet S to the saddle folding unit 40 side.

FIG. 3 is a perspective view illustrating an example of the saddle folding unit 40 in the post-processing apparatus 3 according to the embodiment.

As shown in FIG. 3, the saddle folding unit 40 includes the folding roller 41 and the blade 43.

The folding roller 41 is composed of a pair of rollers forming the nip part 42. One of the pair of rollers in the folding roller 41 is a driving roller 41*a*. The other of the pair of rollers in the folding roller 41 is a driven roller 41*b*.

The driving roller 41*a* is rotationally driven at a fixed position without moving. The driving roller 41*a* is driven by a drive source (not shown). For example, a DC motor is used as a drive source of the driving roller 41*a*. The drive source transmits a driving force to the driving roller 41*a*. For example, the drive source of the driving roller 41*a* also transmits the driving force to the blade 43.

The driven roller 41*b* can be separated from the driving roller 41*a*. The driven roller 41*b* is energized towards the driving roller 41*a* by an energization mechanism (not shown). The driven roller 41*b* rotates following the rotation of the driving roller 41*a*.

At the nip part 42 of the folding roller 41, the blade 43 clamps the central part SC of the sheet S. The folding roller 41 folds the sheet S inserted to the nip part 42 in half and conveys the sheet S folded in half to the conveyance direction downstream side.

The blade 43 is a plate-like member having a thickness in a direction in which the pair of rollers in the folding roller 41 faces each other. The blade 43 can reciprocate so as to insert and remove a front edge to and from the nip part 42. For example, the blade 43 reciprocates through a slider crank mechanism. The blade 43 enters the nip part 42 while pressing the central part SC of the sheet S to the nip part 42. The blade 43 retreats from the nip part 42 while leaving the central part SC of the sheet S in the nip part 42.

As shown in FIG. 1, the guide member 58 is arranged between the folding roller 41 and the sheet S in the sheet conveyance direction D. The guide member 58 is a plate-like member orthogonal to an advancing direction of the blade 43. The guide member 58 guides the sheet S conveyed from the sheet path 54 to the standing state and places it on the stacker 55. The guide member 58 is divided into a first guide member 58*a* and a second guide member 58*b* with a gap capable of moving the blade 43 forward and backward. The blade 43 can advance through the gap between the first guide member 58*a* and the second guide member 58*b* and can press the central part SC (refer to FIG. 3) of the sheet S to the nip part 42. If the central part SC (refer to FIG. 3) of the sheet S is pressed to the nip part 42, a crease is formed in the sheet S. The blade 43 is capable of being drawn from the nip part 42 by retracting after forming the crease on the sheet S.

The stacker 55 includes a support claw 56 and a movement device 57. The support claw 56 supports the lower end of the sheet S in the standing state. The movement device 57 can move the support claw 56 upward and downward.

Above the stacker 55, the stapling unit 60 is arranged. The stapling unit 60 executes the stapling processing to the central part SC of the sheet S in advance according to the type of post-processing. The sheet S placed on the stacker 55 can move upward and downward by moving the support claw 56. For example, the support claw 56 also rises with the displacement of the lower end of the sheet S as the blade 43 presses the sheet S to the nip part 42.

The sheet S placed on the stacker 55 is positioned (aligned) in the sheet conveyance direction D by supporting the lower end of the support claw 56. As shown in FIG. 3, at both sides of the sheet width direction of the stacker 55, a pair of aligning members 55*a* for positioning the sheet S in the sheet width direction W is arranged.

As shown in FIG. 1, the discharge roller 44 for discharging the folding body to the conveyance direction downstream side is arranged at a position separated from the folding roller 41 in the conveyance direction downstream side.

The discharge roller 44 is composed of a pair of rollers forming a nip part 45. One of the pair of rollers of the discharge roller 44 is a driving roller. The other of the pair of rollers of the discharge roller 44 is a driven roller. The driving roller rotates at a fixed position without moving. The driven roller can be separated from the driving roller. The driven roller is energized toward the driving roller by an energization mechanism (not shown). At the nip part 45 of the discharge roller 44, the folding body conveyed by the folding roller 41 is clamped. The discharge roller 44 conveys the folding body inserted to the nip part 45 to the conveyance direction downstream side. The nip part 45 of the discharge roller 44 is opposed to the nip part 42 of the folding roller 41 in the sheet conveyance direction D.

Hereinafter, the stapling unit 60 is described in detail.

As shown in FIG. 1, the stapling unit 60 is arranged above the stacker 55. The stapling unit 60 of the embodiment is a so-called saddle stapler (saddle binding stapler) that executes the stapling processing to the central part of the sheet S. The stapling unit 60 is inclined along the inclination direction of the sheet S on the stacker 55. The stapling unit 60 is inclined in such a manner that the upper side is positioned at the opposite side (the left side of the paper surface) to the image forming apparatus 2.

Figure 4:
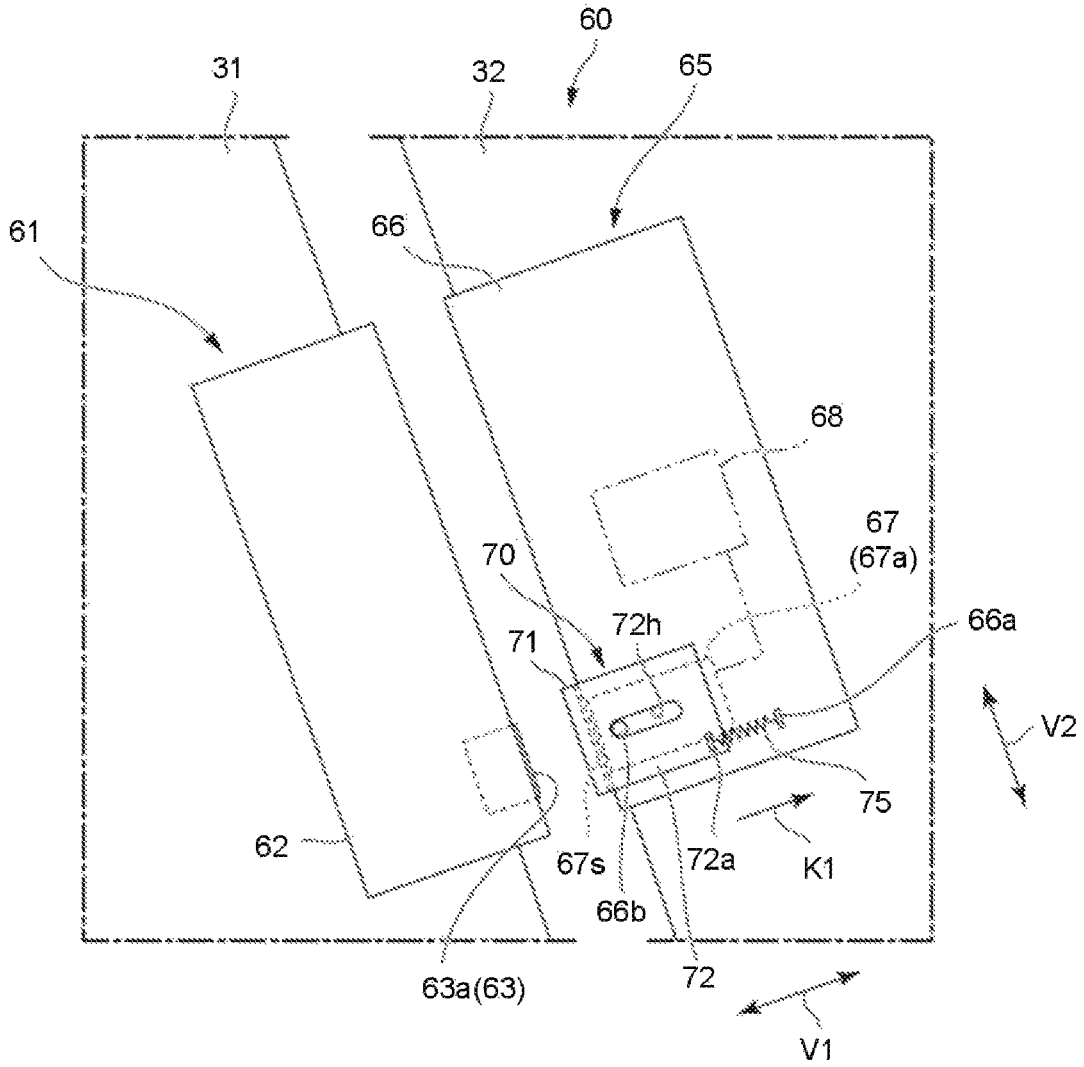
FIG. 4 is a side view illustrating an example of a stapling unit according to the embodiment.

FIG. 4 is a side view illustrating an example of the stapling unit 60 according to the embodiment. FIG. 4 is a diagram illustrating a state before the operation of the stapling unit 60.

As shown in FIG. 4, the stapling unit 60 includes a staple knocking unit 61, a staple receiving unit 65 and a pressing section 70. The staple knocking unit 61 and the staple receiving unit 65 are opposed to the inclination direction of the sheet S on the stacker 55 (refer to FIG. 1) and in a direction orthogonal to the sheet width direction W (refer to FIG. 3). Hereinafter, a direction V1 in which the staple knocking unit 61 and the staple receiving unit 65 face each other is simply referred to as an "opposite direction V1".

The staple knocking unit 61 is described.

The staple knocking unit 61 is positioned at the folding roller 41 side in the opposite direction V1 (refer to FIG. 1). The staple knocking unit 61 includes a knocking unit main body 62 and a knocking section 63.

The knocking unit main body 62 has a rectangular parallelepiped shape. The knocking unit main body 62 is attached to a conveyance path forming section 31 of the sheet S in the post-processing apparatus 3 via a bracket (not shown). Hereinafter, the conveyance path forming section 31 to which the knocking unit main body 62 is attached is also referred to as a "knocking side conveyance path forming section 31".

The knocking section 63 is attached to the lower part of the knocking unit main body 62. The knocking section 63 executes a staple knocking operation at a fixed position without moving.

Figure 7:
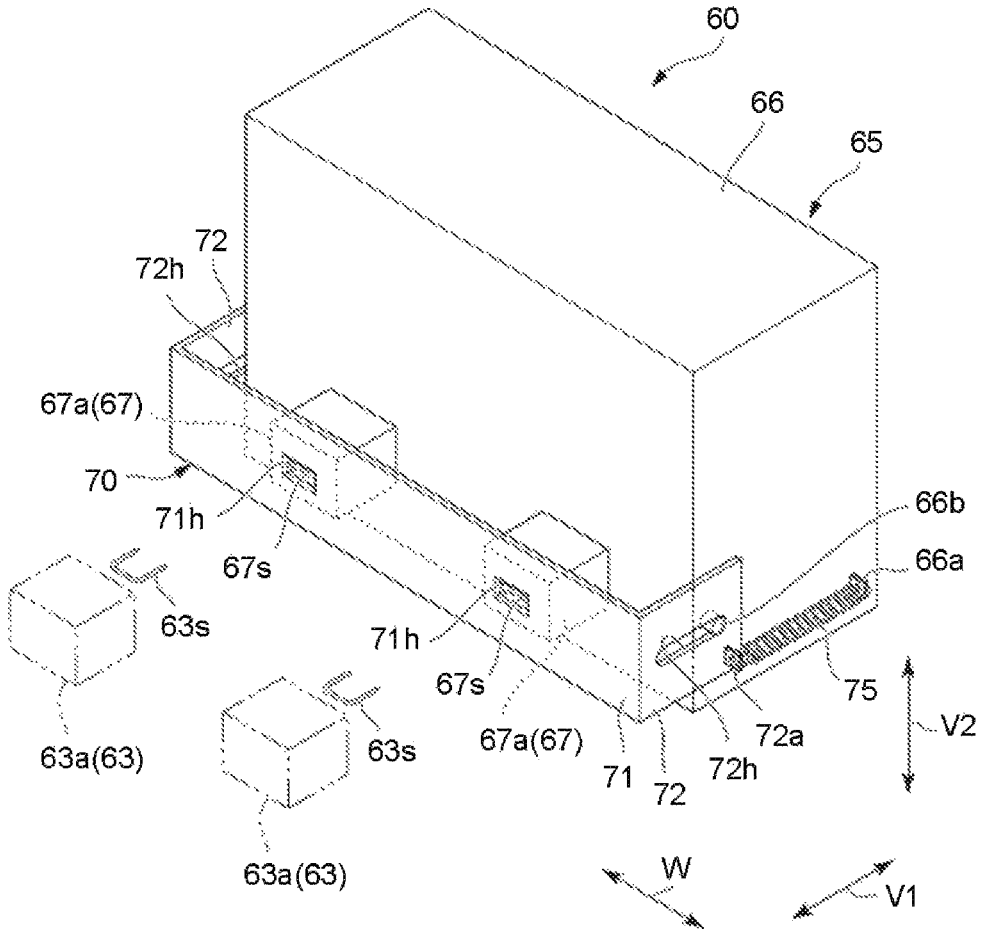
FIG. 7 is a perspective view illustrating the operation of the stapling unit according to the embodiment.

The knocking section 63 includes a pair of driving mechanisms 63*a* (refer to FIG. 7) arranged at intervals in the sheet width direction W. The driving mechanism 63*a* is capable of driving the staple towards the sheet S with the receiving mechanism 67*a*. In FIG. 7, a reference numeral 63*s* denotes a pair of staples driven from the pair of driving mechanisms 63*a*.

The staple receiving unit 65 is described.

The staple receiving unit 65 is positioned at the side opposite to the folding roller 41 in the opposite direction V1 (refer to FIG. 1). The staple receiving unit 65 is positioned at the blade 43 side in the opposite direction V1. The staple receiving unit 65 includes a receiving unit main body 66, a receiving section 67, and a driving section 68.

The receiving unit main body 66 has a rectangular parallelepiped shape. The receiving unit main body 66 is attached to the conveyance path forming section 32 of the sheet S in the post-processing apparatus 3 via a bracket (not shown). Hereinafter, a conveyance path forming section 32 to which the receiving unit main body 66 is attached is also referred to as a "receiving side conveyance path forming section 32". In the opposite direction V1, the conveyance path of the sheet S is formed between the knocking side conveyance path forming section 31 and the receiving side conveyance path forming section 32.

The receiving unit main body 66 is provided with a locking piece 66*a* projecting outward of the sheet width direction W (refer to FIG. 7). Hereinafter, the locking piece 66*a* provided in the receiving unit main body 66 is referred to as a "receiving side locking piece 66*a*". One end of the energization member 75 is locked to the receiving side locking piece 66*a*.

The receiving unit main body 66 is provided with a guide pin 66*b* projecting outward of the sheet width direction W (refer to FIG. 7). The guide pin 66*b* is inserted through a guide hole 72*h* in an extension plate 72.

The receiving section 67 is attached to the bottom of the receiving unit main body 66. The receiving section 67 faces the knocking section 63 via the pressing section 70. The receiving section 67 is movable to the opposite direction V1.

The driving section 68 is built into the receiving unit main body 66. The driving section 68 can move the receiving section 67 to the opposite direction V1. For example, the driving section 68 includes a drive source (not shown) and a slider crank mechanism. For example, the drive source is a motor. The slider crank mechanism converts the rotational motion of the motor to a linear motion. Specifically, the slider crank mechanism converts the rotational motion of the motor to a reciprocating linear motion parallel to the opposite direction V1. The driving section 68 is capable of reciprocating the receiving section 67 to the opposite direction V1.

Figure 5:
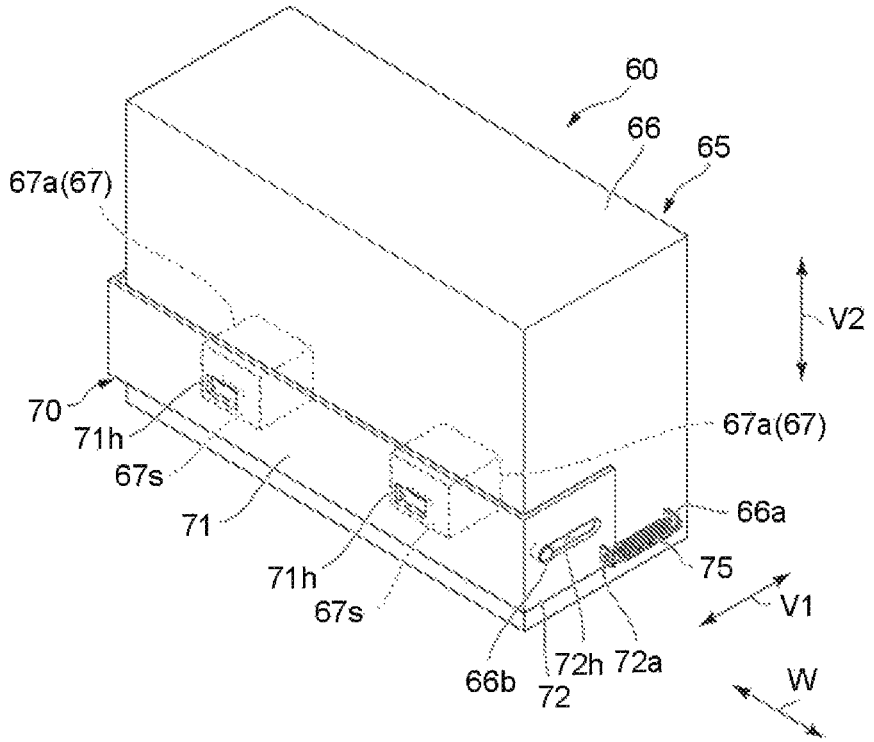
FIG. 5 is a perspective view illustrating an example of the stapling unit according to the embodiment.

FIG. 5 is a perspective view illustrating an example of the stapling unit 60 according to the embodiment. For the sake of convenience, the staple knocking unit 61 is not shown in the figure.

As shown in FIG. 5, the receiving section 67 includes a pair of the receiving mechanisms 67*a* spaced apart in the sheet width direction W. The receiving mechanism 67*a* faces the knocking mechanism 63*a* (refer to FIG. 7). The receiving mechanism 67*a* includes a bending table 67*s* at the side facing the knocking mechanism 63*a*. The bending table 67*s* is used for bending a staple 63*s* (refer to FIG. 7) driven from the knocking mechanism 63*a*.

The pressing section 70 is described.

As shown in FIG. 5, the pressing section 70 extends continuously in the sheet width direction W. The pressing section 70 forms a U shape along the outer shape of the receiving unit main body 66. The pressing section 70 forms a U shape that opens to the receiving unit main body 66 side. The pressing section 70 presses the sheet S at a position where the staple 63*s* (refer to FIG. 7) is knocked. The pressing section 70 presses the sheet S before the staple 63*s* is knocked in the sheet S.

Figure 6:
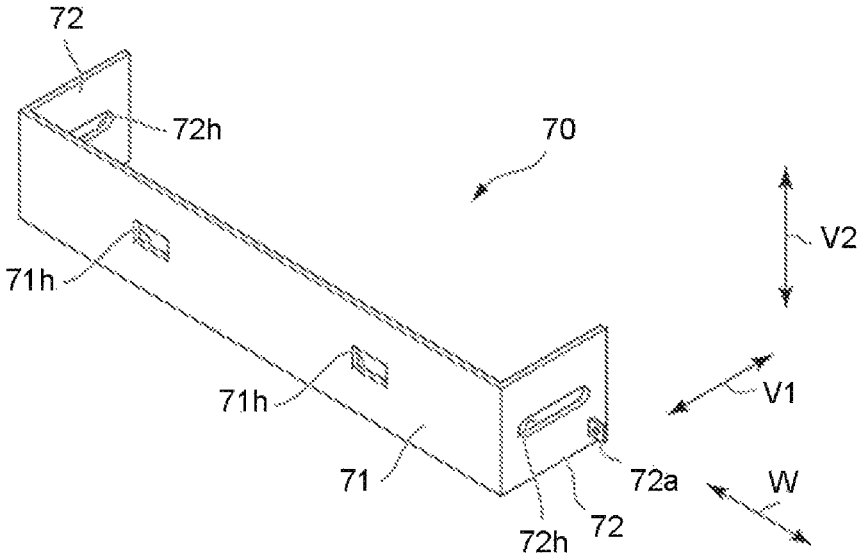
FIG. 6 is a perspective view illustrating an example of a pressing section of the stapling unit according to the embodiment.

FIG. 6 is a perspective view illustrating an example of the pressing section 70 of the stapling unit 60 according to the embodiment.

As shown in FIG. 6, the pressing section 70 includes a pressing plate 71 and an extension plate 72.

The pressing plate 71 is positioned between the knocking section 63 and the receiving section 67 (refer to FIG. 4). The pressing plate 71 is formed into a plate shape extending continuously in the sheet width direction W. Specifically, the pressing plate 71 has a rectangular plate shape having a length in the sheet width direction W and a thickness in the opposite direction V1. As shown in FIG. 5, the pressing plate 71 overlaps with the receiving section 67 in the opposite direction V1. The pressing plate 71 extends continuously in the sheet width direction W to connect a pair of staples around the part stapling the sheet S. As shown in FIG. 4, the lower end of the pressing plate 71 is positioned below the receiving section 67.

As shown in FIG. 6, a pair of the through holes 71*h* opening in the opposite direction V1 is formed in the pressing plate 71. The pair of the through holes 71*h* is spaced apart in the sheet width direction W. As shown in FIG. 5, the through hole 71*h* overlaps with the bending table 67*s* in the receiving section 67 in the opposite direction V1. The through hole 71*h* has a size that allows passing of the staple 63*s* (refer to FIG. 7).

The extension plate 72 extends from the outer end (the outer end in a longitudinal direction) in the sheet width direction W of the pressing plate 71 to the receiving section 67 side in the opposite direction V1. The extension plate 72 forms a plate shape extending continuously in the opposite direction V1 at the side of outer surfaces (both side surfaces) in the sheet width direction W of the receiving unit main body 66. For example, the extension plate 72 has a rectangular plate shape having a length in the opposite direction V1 and a thickness in the sheet width direction W.

A guide hole 72*h* opening in the sheet width direction W is formed in the extension plate 72. The guide hole 72*h* is an elongated hole extending in the opposite direction V1.

The extension plate 72 is provided with the locking piece 72*a* protruding outward in the sheet width direction W. Hereinafter, the locking piece 72*a* provided on the extension plate 72 is referred to as a "pressing side locking piece 72*a*". The other end of the energization member 75 is locked in the pressing side locking piece 72*a*. The other end of the energization member 75 is an opposite end to the one end in which the receiving side locking piece 66*a* is locked.

The post-processing apparatus 3 (refer to FIG. 1) of the embodiment further includes an energization member 75 which energizes the pressing section 70 towards the receiving section 67. The energization member 75 is connected to the receiving side locking piece 66*a* and the pressing side locking piece 72*a*. For example, the energization member 75 is a spring. The energization member 75 has a length in the opposite direction V1. The energization member 75 is stretchable in the opposite direction V1. The driving section 68 (refer to FIG. 4) of the embodiment can move the receiving section 67 in the opposite direction V1 against the energization force of the energization member 75. The driving section 68 extends the energization member 75 if moving the receiving section 67 towards the knocking section 63. The energization member 75 allows the movement of the pressing section 70 to the opposite direction V1. The pressing section 70 moves in the opposite direction V1 in conjunction with the movement of the receiving section 67.

An example of the operation of the stapling unit 60 of the embodiment is described.

The state before the operation of the stapling unit 60 is described.

As shown in FIG. 4, prior to the operation of the stapling unit 60, the receiving section 67 is positioned in the receiving unit main body 66. Specifically, the entire receiving section 67 overlaps with the receiving unit main body 66 in the sheet width direction W. The pressing section 70 is close to the receiving unit main body 66 by the energization force of the energization member 75 in an arrow K1 direction. Between the pressing section 70 and the knocking section 63, a gap through which a plurality of the sheets S can pass is formed.

In FIG. 4, the guide pin 66*b* is positioned at one end of the guide hole 72*h*. One end of the guide hole 72*h* is an end at the side of the knocking section 63 in the opposite direction V1. The pressing section 70 is prevented from moving in the arrow K1 direction by the guide pin 66*b*.

The example of the operation of the stapling unit 60 is described.

FIG. 7 is a perspective view illustrating the operation of the stapling unit 60 according to the embodiment.

As shown in FIG. 7, the receiving section 67 moves toward the knocking section 63 by motor driving of the driving section 68 (refer to FIG. 4). If the receiving section 67 moves towards the knocking section 63, the bending table 67*s* (front end surface) of the receiving section 67 abuts against a back surface of the pressing plate 71 of the pressing section 70. The back surface of the pressing plate 71 is opposite to the surface at the knocking section 63 side of the pressing plate 71.

The receiving section 67 moves towards the knocking section 63 with the bending table 67*s* of the receiving section 67 abutting against the back surface of the pressing plate 71, and in this way, the pressing section 70 moves towards the knocking section 63 in conjunction with the movement of the receiving section 67.

In FIG. 7, the guide pin 66*b* is positioned at the other end of the guide hole 72*h*. The other end of the guide hole 72*h* is opposite to the knocking section 63 side in the opposite direction V1. The pressing section 70 is prevented from moving towards the knocking section 63 by the guide pin 66*b*.

Figure 8:
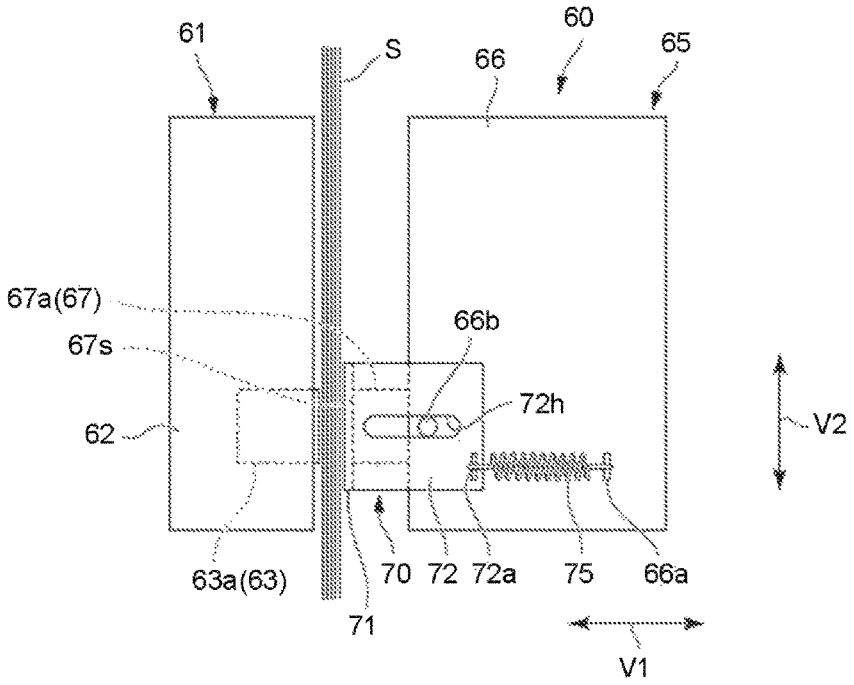
FIG. 8 is a side view illustrating the operation of the stapling unit according to the embodiment.

FIG. 8 is a side view illustrating the operation of the stapling unit 60 according to the embodiment.

As shown in FIG. 8, if a plurality of the sheets S is conveyed between the pressing section 70 and the knocking section 63 as a bundle, the receiving section 67 moves towards the knocking section 63. As the receiving section 67 moves towards the knocking section 63, the pressing section 70 moves towards the knocking section 63 in conjunction with the movement of the receiving section 67. If the pressing section 70 moves toward the knocking section 63, the pressing section 70 presses the plurality of the sheets S in the opposite direction V1. Hereinafter, the plurality of sheets S pressed by the pressing section 70 is also referred to as a "sheet bundle". The pressing section 70 presses the sheet bundle before the staple 63*s* (refer to FIG. 9) is knocked into the sheet bundle.

Figure 9:
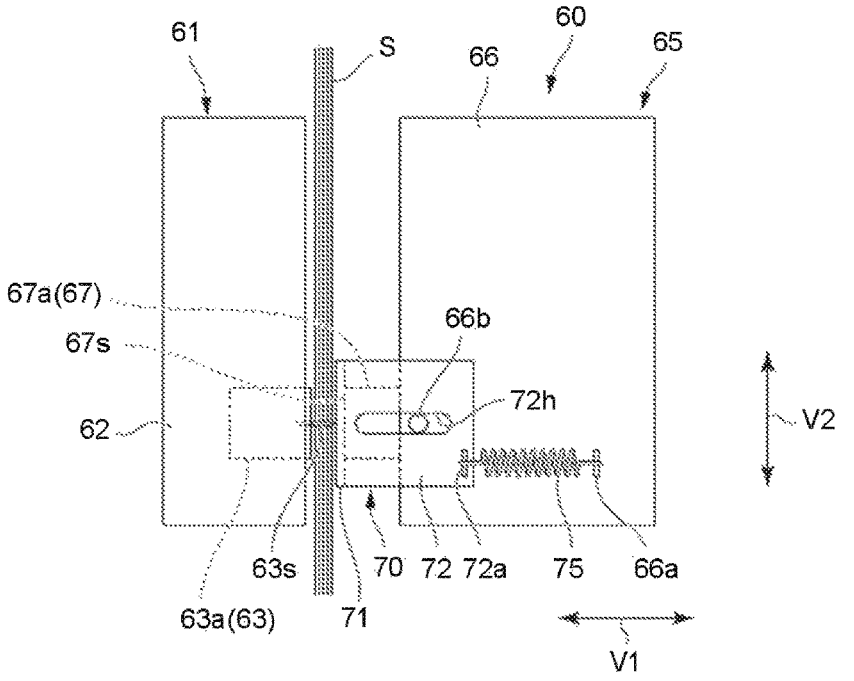
FIG. 9 is a side view illustrating the operation of the stapling unit according to the embodiment following FIG. 8.

FIG. 9 is a side view illustrating the operation of the stapling unit 60 according to the embodiment following FIG. 8.

As shown in FIG. 9, with the pressing section 70 pressing the sheet bundle, the knocking section 63 knocks the staple 63*s* in the sheet bundle. The receiving section 67 receives the staple 63*s* knocked from the knocking section 63 via the through hole 71*h* (refer to FIG. 7) of the pressing plate 71. The bending table 67*s* of the receiving section 67 bends the received staple 63*s*. By bending the staple 63*s* in the bending table 67*s*, the sheet bundle is stapled by the staple 63*s*.

The function of the pressing section 70 of the embodiment is described.

Figure 10:
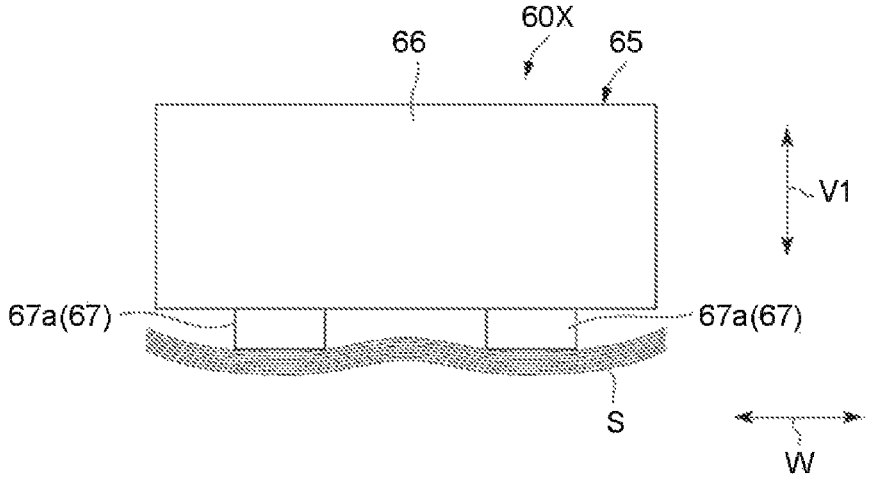
FIG. 10 is a view illustrating the function of a stapling unit according to a comparative embodiment.

FIG. 10 is a view illustrating the function of a stapling unit 60X according to a comparative embodiment.

Figure 11:
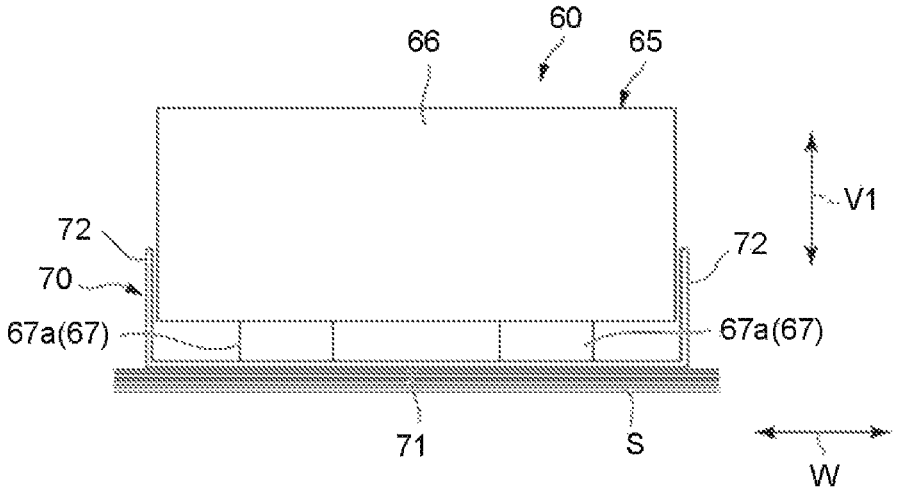
FIG. 11 is a view illustrating the function of the stapling unit according to the embodiment.

FIG. 11 is a view illustrating the function of the stapling unit 60 according to the embodiment.

FIG. 10 and FIG. 11 are diagrams obtained by viewing the stapling unit from a direction V2 (refer to FIG. 7) orthogonal to the sheet width direction W and the opposite direction V1. For the sake of convenience, the knocking section 63 is not shown in FIG. 10 and FIG. 11.

The function of the stapling unit 60X of the comparative embodiment is described.

The stapling unit 60X of the comparative embodiment does not include the pressing section 70 in the embodiment.

As shown in FIG. 10, in the comparative embodiment, the pair of the receiving mechanisms 67*a* in the receiving section 67 directly presses the sheet bundle in the opposite direction V1. The pair of the receiving mechanisms 67*a* presses only a local part of the sheet bundle in the sheet width direction W. If the pair of the receiving mechanisms 67*a* locally presses the sheet bundle, there is a possibility that the deflection may occur in the sheet bundle in the sheet width direction W. Therefore, even if the staple is knocked in the sheet bundle, there is a possibility that deflection occurs in the sheet bundle in the sheet width direction W. If the deflection occurs in the sheet bundle, there is a possibility that the staple position with respect to the sheet bundle is deviated. FIG. 10 shows an example in which the deflection occurs in the sheet bundle in the sheet width direction W.

In contrast, according to the embodiment, the post-processing apparatus 3 has the knocking section 63, the receiving section 67, the driving section 68, and the pressing section 70. The knocking section 63 knocks staple 63*s* in the sheet S. The receiving section 67 faces the knocking section 63. The receiving section 67 receives the staple 63*s* knocked from the knocking section 63. The driving section 68 can move the receiving section 67 in the opposite direction V1 in which the knocking section 63 and the receiving section 67 face each other. The pressing section 70 extends continuously in the sheet width direction W. The pressing section 70 presses the sheet S before staples 63*s* are knocked in the sheet S. With the above constitution, the following effects are achieved. Before the staple 63*s* is knocked in the sheet S, the deflection can be prevented from occurring in the sheet S in the sheet width direction W because the pressing section 70 can press the sheet S continuously in the sheet width direction W. Therefore, even if the staple 63*s* is knocked in the sheet S, the occurrence of the deflection in the sheet S in the sheet width direction W can be suppressed. Therefore, it is possible to prevent the staple position from deviating from the sheet S. FIG. 11 shows an example in which the pressing section 70 presses the sheet bundle continuously in the sheet width direction W before the staple 63*s* is knocked in the sheet bundle.

The post-processing apparatus 3 further includes the energization member 75 energizing the pressing section 70 towards the receiving section 67. The driving section 68 can move the receiving section 67 in the opposite direction V1 against the energization force of the energizing member 75. With the above constitution, the following effects are achieved. The pressing section 70 can be moved in the opposite direction V1 in conjunction with the movement of the receiving section 67. Therefore, compared with a case of further including the driving mechanism capable of moving the pressing section 70 in the opposite direction V1, it is possible to simplify the apparatus constitution and reduce cost.

In the pressing section 70, the guide hole 72*h* extending in the opposite direction V1 is formed. The post-processing apparatus 3 further includes the guide pin 66*b* inserted through the guide hole 72*h*. With the above constitution, the following effects are achieved. Since the pressing section 70 can be moved along the guide hole 72*h* extending in the opposite direction V1, the movement direction of the pressing section 70 can be restricted to one direction of the opposite direction V1. Therefore, the pressing section 70 can accurately press the sheet S.

The pressing section 70 has the plate-like pressing plate 71 extending continuously in the sheet width direction W between the knocking section 63 and the receiving section 67, and the following effects are achieved. Before the staple 63*s* is knocked in the sheet S, the pressing plate 71 can press the sheet S continuously in the sheet width direction W. Therefore, it is possible to more effectively suppress the occurrence of the deflection in the sheet S in the sheet width direction W compared with the case in which the pressing section 70 is formed in a bar shape. Therefore, it is possible to suppress the deviation of the staple position in the sheet S more effectively.

The pressing section 70 includes the extension plate 72 extending from the outer end of the pressing plate 71 to the receiving section 67 side in the opposite direction V1. In the extension plate 72, the guide hole 72*h* is formed. With the above constitution, the following effects are achieved. The guide hole 72*h* extending in the opposite direction V1 can be formed by using an extending direction of the extension plate 72. In addition, the pressing plate 71 and the extension plate 72 can be integrally formed by bending one plate-like member. Therefore, the pressing section 70 can be easily manufactured.

The lower end of the pressing section 70 is positioned below the driving section 68, and thus, the following effects are achieved. The lower part of the sheet S can be prevented from hanging by its own weight since the pressing section 70 easily presses the lower side of the sheet S by compared with the case in which the lower end of the pressing section 70 is arranged above the driving section 68. It is possible to suppress the occurrence of position deviation in the sheet S in the sheet conveyance direction D (direction V2). Therefore, it is possible to suppress the deviation of the staple position in the sheet S more effectively.

Hereinafter, a modification of the embodiment is described.

A first medication of the embodiment is described.

The pressing section 70 is not limited to moving in conjunction with the movement of the receiving section 67.

Figure 12:
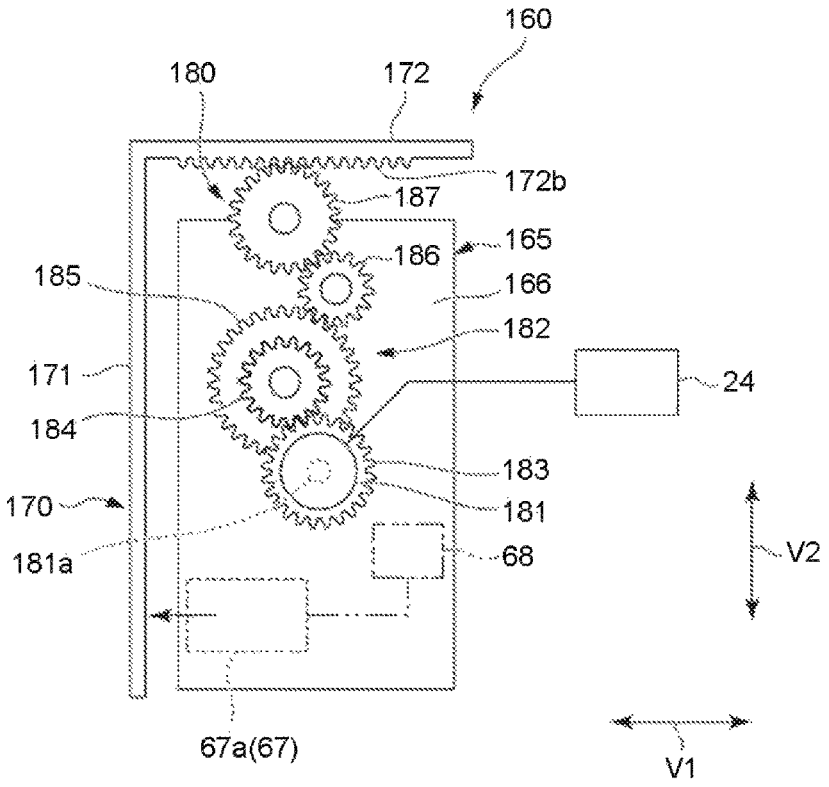
FIG. 12 is a side view illustrating an example of a stapling unit according to a first modification of the embodiment.

FIG. 12 is a side view illustrating an example of the stapling unit 60 according to the first modification of the embodiment. For sake of convenience, in FIG. 12, the knocking section 63 is not shown in the figure.

As shown in FIG. 12, the staple receiving unit 165 may further include a driving mechanism 180 capable of moving a pressing section 170 in the opposite direction V1. As viewed from the sheet width direction W, the pressing section 170 of the present modification is formed in an L shape.

The driving mechanism. 180 includes a drive source 181 and a power transmission mechanism 182. For example, the drive source 181 is a motor. The power transmission mechanism 182 converts the rotational motion of the motor to a linear motion. Specifically, the power transmission mechanism 182 converts the rotational motion of the motor to the linear motion parallel to the opposite direction V1. By forward and reverse rotation of the motor, the receiving section 67 can reciprocate in the opposite direction V1.

The power transmission mechanism 182 includes a plurality of gears 183~187. The plurality of gears 183~187 is a first gear 183, a second gear 184, a third gear 185, a fourth gear 186, and a fifth gear 187. The first gear 183 is connected to a shaft portion 181*a* of the motor, and the second gear 184 meshes with the first gear 183. The second gear 184 is driven to rotate by the rotation of the first gear 183. The third gear 185 is bonded coaxially with the second gear 184. The third gear 185 rotates with the second gear 184. The fourth gear 186 meshes with the third gear 185. The fourth gear 186 is driven to rotate by the rotation of the third gear 185. The fifth gear 187 meshes with the fourth gear 186. The fifth gear 187 is driven to rotate by the rotation of the fourth gear 186.

An extension plate 172 extends from the upper end of the pressing plate 171 to the receiving section 67 side in the opposite direction V1. The extension plate 172 forms a plate shape extending continuously in the opposite direction V1 above the upper surface of a receiving unit main body 166. Specifically, the extension plate 172 has a rectangular plate shape having a length in the opposite direction V1 and a thickness in the vertical direction.

The driving mechanism 180 is connected to the extension plate 172. Specifically, the extension plate 172 constitutes a rack with a tooth 172*b* mounted on lower surface. The tooth 172*b* on the lower surface of the extension plate 172 meshes with the fifth gear 187. The extension plate 172 moves in the horizontal direction according to the rotation of the fifth gear 187. The extension plate 172 and the fifth gear 187 constitute a rack and pinion.

An example of the control of the stapling unit 160 according to the first medication of the embodiment is described.

Figure 13:
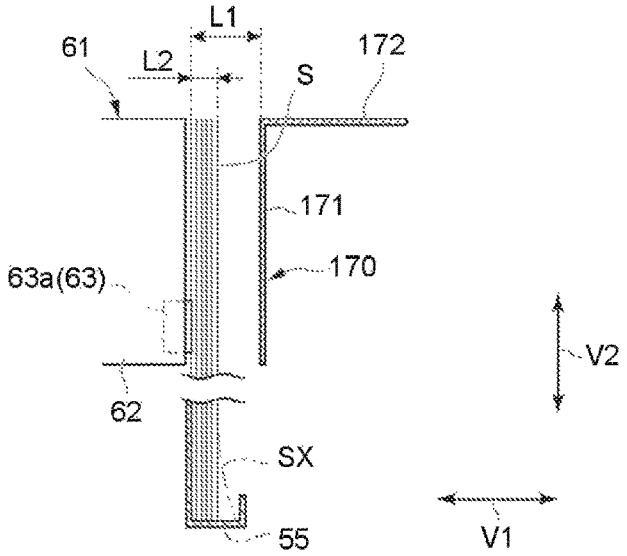
FIG. 13 is a side view illustrating an example of the control of the stapling unit according to the first modification of the embodiment.

FIG. 13 is a side view illustrating an example of the control of the stapling unit 160 according to the first modification of the embodiment.

As shown in FIG. 13, the post-processing controller 24 (refer to FIG. 2) controls the driving mechanism 180 (refer to FIG. 12) based on job information and changes an interval L1 between the knocking section 63 and the pressing section 170. For example, the job information is information relating to the number of the sheets S, the thickness of the sheet S, and the like. Hereinafter, the interval between the knocking section 63 and the pressing section 170 is also referred to as a "sheet arrangement interval L1".

The post-processing controller 24 sets the sheet arrangement interval L1 to the first interval before the sheet S is conveyed between the knocking section 63 and the pressing section 170. If the number of the sheets S conveyed between the knocking section 63 and the pressing section 170 is equal to or less than a threshold value, the post-processing controller 24 sets the sheet arrangement interval L1 to a second interval narrower than the first interval.

For example, the post-processing controller 24 controls the driving mechanism 180 (refer to FIG. 12) to narrow the sheet arrangement interval L1 if the number of sheets S conveyed between the knocking section 63 and the pressing section 170 is five or less. On the other hand, if the number of the sheets S conveyed between the knocking section 63 and the pressing section 170 exceeds five, the post-processing controller 24 does not control the driving mechanism 180 but maintains the sheet arrangement interval L1.

If a ratio L2/L1 of the thickness L2 of the sheet S conveyed between the knocking section 63 and the pressing section 170 to the sheet arrangement interval L1 is less than or equal to a threshold value, the post-processing controller 24 sets the sheet arrangement interval L1 to the second interval narrower than the first interval. The thickness L2 of the sheet conveyed between the knocking section 63 and the pressing section 170 means a total thickness of one or more sheets S (sheet bundle).

For example, the post-processing controller 24 controls the driving mechanism 180 to narrow the sheet arrangement interval L1 if the ratio L2/L1 of the sheet thickness L2 to the sheet arrangement interval L1 is 0.3 or less. On the other hand, if the ratio L2/L1 of the sheet thickness L2 to the sheet arrangement interval L1 exceeds 0.3, the post-processing controller 24 maintains the sheet arrangement interval L1 without controlling the driving mechanism 180.

According to the first medication of the embodiment, the post-processing apparatus 3 further includes the driving mechanism 180 which can move the pressing section 170 in the opposite direction V1, and in this way, the following effects are achieved. The pressing section 170 can be moved separately and independently from the receiving section 67. Therefore, the driving section 68 (motor) can be downsized compared with the constitution (refer to FIG. 4) in which the pressing section 70 moves in conjunction with the movement of the receiving section 67 (refer to FIG. 4).

The post-processing controller 24 controls the driving mechanism 180 based on the job information to change the sheet arrangement interval L1, and in this way, the following effects are achieved. If the thickness L2 of the sheet S conveyed between the knocking section 63 and the pressing section 170 is excessively small with respect to the sheet arrangement interval L1, there is a high possibility that the lower part of the sheet S hangs by its own weight. On the other hand, according to the present modification, by changing the sheet arrangement interval L1 in advance based on the job information, the sheet arrangement interval L1 can be set to a size suitable for the thickness L2 of the conveyed sheet S. Therefore, it is possible to prevent the lower part of the sheet S from hanging by its own weight. In FIG. 13, a symbol SX indicates a state in which the lower part of the sheet hangs by its own weight.

The post-processing controller 24 sets the sheet arrangement interval L1 to the first interval before the sheet S is conveyed between the knocking section 63 and the pressing section 170. If the number of the sheets S conveyed between the knocking section 63 and the pressing section 170 is equal to or less than the threshold value, the post-processing controller 24 sets the sheet arrangement interval L1 to the second interval narrower than the first interval. With the above constitution, the following effects are achieved. It is possible to avoid the thickness L2 of the sheet conveyed between the knocking section 63 and the pressing section 170 from becoming too small with respect to the sheet arrangement interval L1. Therefore, it is possible to prevent the sheet S from hanging by its own weight more effectively.

A second modification of the embodiment is described.

If the number of the sheets S conveyed between the knocking section 63 and the pressing section 170 is equal to or less than the threshold value, the post-processing controller 24 is not limited to setting the sheet arrangement interval L1 to the second interval narrower than the first interval.

For example, the post-processing controller 24 may widen the sheet arrangement interval L1 every time the sheet S is conveyed by a predetermined number between the knocking section 63 and the pressing section 170. For example, the post-processing controller 24 may widen the sheet arrangement interval L1 every time three sheets S are conveyed between the knocking section 63 and the pressing section 170. For example, the initial sheet arrangement interval L1 is narrow, and the sheet arrangement interval L1 is gradually widened every time the sheet S is conveyed.

According to the second modification of the embodiment, the sheet arrangement interval L1 can be gradually expanded according to the number of sheets S conveyed between the knocking section 63 and the pressing section 170. Therefore, it is possible to more effectively prevent the lower part of the sheet S from hanging by its own weight compared with a case in which the sheet arrangement interval L1 is widened from the beginning.

Other modifications of the embodiment are described.

The driving section 68 is not limited to being able to move the receiving section 67 in the opposite direction V1. For example, the driving section 68 may be able to move the knocking section 63 in the opposite direction V1. Alternatively, the driving section 68 may be able to move both the receiving section 67 and the knocking section 63 in the opposite direction V1. The driving section 68 may change the interval between the knocking section 63 and the receiving section 67 in the opposite direction V1.

The pressing section 70 is not limited to including a plate-like pressing plate 71 extending continuously in the sheet width direction W between the knocking section 63 and the receiving section 67. For example, the pressing section 70 may have a bar-like pressing bar extending continuously in the sheet width direction W between the knocking section 63 and the receiving section 67. The pressing section 70 may extend continuously in the sheet width direction W.

The knocking section 63 is not limited to having a pair of the knocking mechanisms 63*a* arranged spaced apart in the sheet width direction W. For example, the knocking section 63 may have only one the knocking mechanism 63*a*. Alternatively, the knocking section 63 may include three or more the knocking mechanisms 63*a* spaced apart in the sheet width direction W.

The receiving section 67 is not limited to having a pair of the receiving mechanism 67*a* spaced apart in the sheet width direction W. For example, the receiving section 67 may have only one receiving mechanism 67*a*. Alternatively, the receiving section 67 may include three or more receiving mechanisms 67*a* spaced apart in the sheet width direction W. The receiving mechanism 67*a* may be arranged at a position facing the knocking mechanism 63*a*.

The post-processing apparatus 3 is not limited to further including the driving mechanism 180 that can move the pressing section 170 in the opposite direction V1. For example, the post-processing apparatus 3 may have a drive source shared by the receiving section 67 and the pressing section 170.

The power transmission mechanism 182 is not limited to including a plurality of gears 183~187. For example, the power transmission mechanism 182 may include a plurality of belts or a plurality of rollers. The power transmission mechanism 182 may include a plurality of rotating bodies.

The stapling unit 60 is not limited to being a so-called saddle stapler (saddle binding stapler) that executes the stapling processing to the center of the sheet S.

Figure 14:
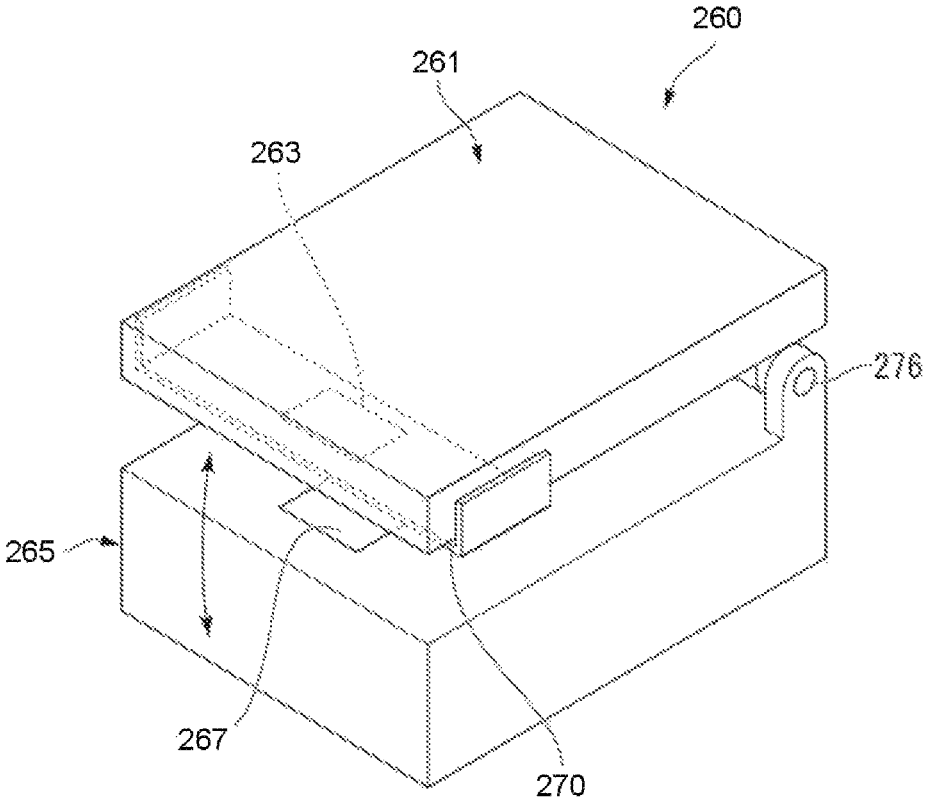
FIG. 14 is a perspective view illustrating an example of a stapling unit according to another modification of the embodiment.

FIG. 14 is a perspective view illustrating an example of a stapling unit 260 according to another modification of the embodiment.

As shown in FIG. 14, the stapling unit 260 may be a so-called console stapler (end binding stapler) that executes the stapling processing to the end of the sheet S. In FIG. 14, a reference numeral 261 denotes the staple receiving unit, a reference numeral 263 denotes the receiving section, a reference numeral 265 denotes the staple knocking unit, a reference numeral 267 denotes the knocking section, and a reference numeral 270 denotes the pressing section. For example, the staple receiving unit 261 rotates about a rotation axis 276, and in this way, the receiving section 263 is movable toward the knocking section 267. In addition, the receiving section 263 is movable towards the knocking section 267 by a motor driving of the driving section (not shown). For example, the pressing section 270 moves in conjunction with the movement of the receiving section 263.

According to at least one embodiment described above, the post-processing apparatus 3 has the knocking section 63, the receiving section 67, the driving section 68, and the pressing section 70. The knocking section 63 knocks staple 63*s* in the sheet S. The receiving section 67 faces the knocking section 63. The receiving section 67 receives the staple 63*s* knocked from the knocking section 63. The driving section 68 can change the interval between the knocking section 63 and the receiving section 67 in the opposite direction V1 in which the knocking section 63 and the receiving section 67 face each other. The pressing section 70 extends continuously in the sheet width direction W. The pressing section 70 presses the sheet S before the staple 63*s* is knocked in the sheet S. With the above constitution, the following effects are achieved. Before the staple 63*s* is knocked in the sheet S, the deflection can be prevented from occurring in the sheet S in the sheet width direction W because the pressing section 70 can press the sheet S continuously in the sheet width direction W. Therefore, even if the staple 63*s* is knocked in the sheet S, the occurrence of the deflection in the sheet S in the sheet width direction W can be suppressed. Therefore, it is possible to prevent the staple position from deviating in the sheet S.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A post-processing apparatus, comprising:

a knocking section configured to knock a staple in a sheet;

a receiving section, facing the knocking section, configured to receive the sheet in which the staple is knocked from the knocking section;

a driving section configured to change an interval between the knocking section and the receiving section in an opposite direction in which the knocking section and the receiving section face each other;

a pressing section, extending continuously in a sheet width direction, configured to press the sheet before the staple is knocked in the sheet; and an energization member configured to energize the pressing section towards the receiving section, wherein the driving section is further configured to move the receiving section against an energization force of the energization member in the opposite direction.

2. The post-processing apparatus according to claim 1, further comprising:

a guide pin inserted through a guide hole, wherein the guide hole extending in the opposite direction is positioned in the pressing section.

3. The post-processing apparatus according to claim 2, wherein the pressing section comprises a plate-like pressing plate extending continuously in the sheet width direction between the knocking section and the receiving section, and an extension plate extending towards the receiving section side from an outer end of the pressing plate in the opposite direction and on which the guide hole is positioned.

4. The post-processing apparatus according to claim 3, wherein a lower end of the pressing plate is positioned below the receiving section.

5. The post-processing apparatus according to claim 1, wherein the receiving section comprises a pair of a receiving mechanisms spaced apart in the sheet width direction, the receiving mechanisms facing the knocking section.

6. A multifunction peripheral comprising the post-processing apparatus according to claim 1.

7. A post-processing apparatus, comprising:

a knocking section configured to knock a staple in a sheet;

a receiving section, facing the knocking section, configured to receive the sheet in which the staple is knocked from the knocking section;

a driving section configured to change an interval between the knocking section and the receiving section in an opposite direction in which the knocking section and the receiving section face each other;

a pressing section, extending continuously in a sheet width direction, configured to press the sheet before the staple is knocked in the sheet;

a driving mechanism configured to move the pressing section in the opposite direction; and an energization member configured to energize the pressing section towards the receiving section, wherein the driving section is further configured to move the receiving section against an energization force of the energization member in the opposite direction.

8. The post-processing apparatus according to claim 7, wherein the pressing section comprises a plate-like pressing plate extending continuously in the sheet width direction between the knocking section and the receiving section, and an extension plate extending towards the receiving section side from an outer end of the pressing plate in the opposite direction for connection to the driving mechanism.

9. The post-processing apparatus according to claim 7, further comprising:

a controller configured to control the driving mechanism based on job information to change an interval between the knocking section and the pressing section.

10. The post-processing apparatus according to claim 9, wherein the controller sets the interval before the sheet is conveyed between the knocking section and the pressing section to a first interval, and sets the interval if a number of the sheets conveyed between the knocking section and the pressing section is equal to or smaller than a threshold value to a second interval narrower than the first interval.

11. The post-processing apparatus according to claim 9, wherein the controller increases the interval each time a predetermined number of sheets is conveyed between the knocking section and the pressing section.

12. The post-processing apparatus according to claim 7, wherein the receiving section comprises a pair of a receiving mechanisms spaced apart in the sheet width direction, the receiving mechanisms facing the knocking section.

13. A multifunction peripheral comprising the post-processing apparatus according to claim 7.

14. A method of reducing deviation from an intended position of a staple in a sheet to an unintended position of the staple in the sheet, comprising:

receiving the sheet in which a staple is knocked in a receiving section;

pressing the sheet continuously in a sheet width direction before the staple is knocked in the sheet in a pressing section;

knocking a staple in the sheet using a knocking section facing the receiving section;

changing an interval between the knocking section and the receiving section in an opposite direction in which the knocking section and the receiving section face each other; and moving the receiving section against an energization force in the opposite direction.

15. The method according to claim 14, further comprising:

pressing with a plate-like pressing plate extending continuously in the sheet width direction and moving the plate-like pressing plate in the opposite direction.

16. The method according to claim 14, further comprising:

controlling changing the interval based on job information.

17. The method according to claim 16, wherein controlling comprises setting the interval before knocking the sheet to a first interval and setting the interval if a number of the sheets to be knocked is equal to or smaller than a threshold value to a second interval narrower than the first interval.

18. The method according to claim 16, wherein controlling comprises increasing the interval each time a predetermined number of sheets are received in the receiving section.

* * * * *